US007559200B2

(12) United States Patent
Rodehau et al.

(10) Patent No.: US 7,559,200 B2
(45) Date of Patent: Jul. 14, 2009

(54) MULTISTAGE TURBOCOMPRESSOR

(75) Inventors: Michael Rodehau, Oberhausen (DE); Wulf-Dirk Andres, Hagen (DE); Klaus Thieme, Oberhausen (DE)

(73) Assignee: MAN Turbo AG, Oberhausen (DE)

( * ) Notice: Subject to any disclaimer, the term of this patent is extended or adjusted under 35 U.S.C. 154(b) by 126 days.

(21) Appl. No.: 11/333,649

(22) Filed: Jan. 17, 2006

(65) Prior Publication Data

US 2006/0156728 A1 Jul. 20, 2006

(30) Foreign Application Priority Data

Jan. 19, 2005 (DE) ..... 10 2005 002 702

(51) Int. Cl.
*F02B 33/44* (2006.01)

(52) U.S. Cl. ..... 60/612; 60/605.1

(58) Field of Classification Search ..... 123/562, 123/559.3; 60/612, 607–609; 415/60, 122.1, 415/124.1

See application file for complete search history.

(56) References Cited

U.S. PATENT DOCUMENTS

| | | | | | |
|---|---|---|---|---|---|
| 1,435,821 | A * | 11/1922 | Dorsey | 475/339 |
| 3,001,692 | A * | 9/1961 | Schierl | 415/66 |
| 3,741,676 | A * | 6/1973 | Silvern et al. | 415/58.1 |
| 3,826,587 | A | 7/1974 | Hornschuch | |
| 4,086,019 | A * | 4/1978 | Poole | 415/18 |
| 4,087,197 | A * | 5/1978 | Haugen | 415/66 |
| 4,219,306 | A * | 8/1980 | Fujino et al. | 415/62 |
| 5,154,571 | A * | 10/1992 | Prumper | 415/58.1 |
| 5,382,132 | A * | 1/1995 | Mendel | 415/60 |
| 5,402,631 | A * | 4/1995 | Wulf | 60/783 |
| 5,490,760 | A * | 2/1996 | Kotzur | 415/68 |
| 5,611,663 | A * | 3/1997 | Kotzur | 415/122.1 |
| 5,634,374 | A | 6/1997 | Depietri | |
| 6,050,780 | A * | 4/2000 | Hasegawa et al. | 417/44.11 |
| 6,692,224 | B2 * | 2/2004 | Miura et al. | 415/66 |

FOREIGN PATENT DOCUMENTS

| | | |
|---|---|---|
| DE | 974 418 | 11/1960 |
| DE | 71 22 098 | 2/1972 |
| DE | 2413674 | 11/1974 |
| DE | 92 01 858 | 5/1992 |
| DE | 42 41 141 | 6/1994 |

(Continued)

*Primary Examiner*—Thomas Denion
*Assistant Examiner*—Donglas J. Duff
(74) *Attorney, Agent, or Firm*—McGlew and Tuttle, P.C.

(57) ABSTRACT

A multistage turbocompressor, designed as a geared compressor with an integrated gear, contains a central greater wheel (9) that meshes with a plurality of pinions (14, 15), wherein each pinion (14, 15) is mounted, in a manner adapted to rotate in unison, on a pinion shaft (16, 17). A bladed wheel of a compressor stage (II, III, IV, V) is arranged on the ends of each of the pinion shafts. The greater wheel (9) meshes with a driving pinion (8), which is mounted, in a manner adapted to rotate in unison, on a driving shaft 6 connected to a drive unit (1). The axis of the driving pinion (8) is arranged, with the axis of the greater wheel (9), in the same horizontal plane (20), and the driving pinion (8) meshes with a pinion (10) of a first compressor stage (I) mounted, in a manner adapted to rotate in unison, on a pinion shaft (11).

20 Claims, 2 Drawing Sheets

FOREIGN PATENT DOCUMENTS

| | | |
|---|---|---|
| DE | 694 04 772 | 9/1995 |
| EP | 0 440 902 | 8/1991 |
| EP | 0 440 902 | 6/1994 |
| EP | 1 302 668 | 4/2003 |
| GB | 967 091 | 8/1964 |
| GB | 1 438 211 | 6/1976 |
| GB | 2 321 502 | 7/1998 |

* cited by examiner

MULTISTAGE TURBOCOMPRESSOR

CROSS REFERENCE TO RELATED APPLICATIONS

This application claims the benefit of priority under 35 U.S.C. § 119 of German Patent Application DE 10 2005 002 702.4 filed Jan. 19, 2005, the entire contents of which are incorporated herein by reference.

FIELD OF THE INVENTION

The present invention pertains to a multistage turbocompressor, which is designed as a geared compressor with an integrated gear, with the features of the preamble of claim 1.

BACKGROUND OF THE INVENTION

Prior-art geared compressors (DE 974 418, EP 0 440 902 B1, EP 1 302 668 A1) are characterized by a greater wheel that meshes with a plurality of pinions. One or two compressor stages are each fastened to the pinions. The pinions surround the greater wheel, which is driven directly, as the shaft of the greater wheel is coupled with the driving shaft. Another possibility of coupling the drive unit to the geared compressor may take place via a driving pinion, which, like the pinions of the compressor stages, likewise meshes with the greater wheel. Because of the design of a geared compressor, the driving pinion is arranged under the greater wheel. Such a geared compressor requires a height offset in installation, since the shaft of the greater wheel and the shaft of the drive unit lie apart from one another by a distance that results from the sum of the radius of the greater wheel and the radius of the drive unit. Consequently, additional space is required for installation.

SUMMARY OF THE INVENTION

The object of the present invention is to design a multistage turbocompressor with integrated gear such that a compact arrangement of a line of machines consisting of a turbocompressor and drive unit is possible.

According to the invention, a multistage turbocompressor is designed as a geared compressor with an integrated gear, which comprises a central greater wheel that meshes with a plurality of pinions (pinion gears). Each pinion is mounted on a pinion shaft in a manner adapted to rotate in unison therewith. On the ends of the respective pinion shafts there is arranged a bladed wheel of a compressor stage. The greater wheel meshes with a driving pinion which is mounted on a driving shaft connected to a drive unit. The driving pinion is mounted in a manner adapted to rotate in unison with the driving shaft. The axis of the driving pinion with the axis of the greater wheel is arranged in the same horizontal plane. The driving pinion meshes with a pinion of a first compressor stage mounted on a pinion shaft.

A line of machines, in which a common central plane is present for the turbocompressor and the drive unit, can be set up by means of the multistage turbocompressor designed according to the present invention. If this line of machines is expanded by additional units, such as, for example, a motor/generator and/or an expander, then the common central plane is available for the additional units as well. By means of the common central plane, a height offset in the base frame, on which the units are assembled, as well as in the foundation bed (steel framing or concrete) of the line of machines is avoided. The space required for the installation of the line of machines becomes smaller, as a result of which the production, transportation, operation and maintenance of the line of machines become simpler and more cost-favorable. The construction of larger compressors becomes possible, since the space required for the compressor housing is increased. Finally, the mechanical strain on the individual components, such as the driving pinion, the bearing and the gear housing, is reduced.

The pinions meshing with the central greater wheel may advantageously be arranged in the horizontal plane running through the axis of the greater wheel and above this plane.

The drive unit may be designed as a steam turbine and may be arranged together with the geared compressor in a line of machines. The axis of the drive unit and the axis of the greater wheel of the geared compressor may be arranged in the same horizontal plane.

The geared compressor may be arranged in a line of machines between the drive unit designed as a steam turbine on one side and a motor/generator connected to an expander on the other side. The axis of the drive unit, of the greater wheel, of the geared compressor, of the motor/generator and of the expander may be arranged in the same horizontal plane.

An exemplary embodiment of the present invention is shown in the drawings and is explained in detail below. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
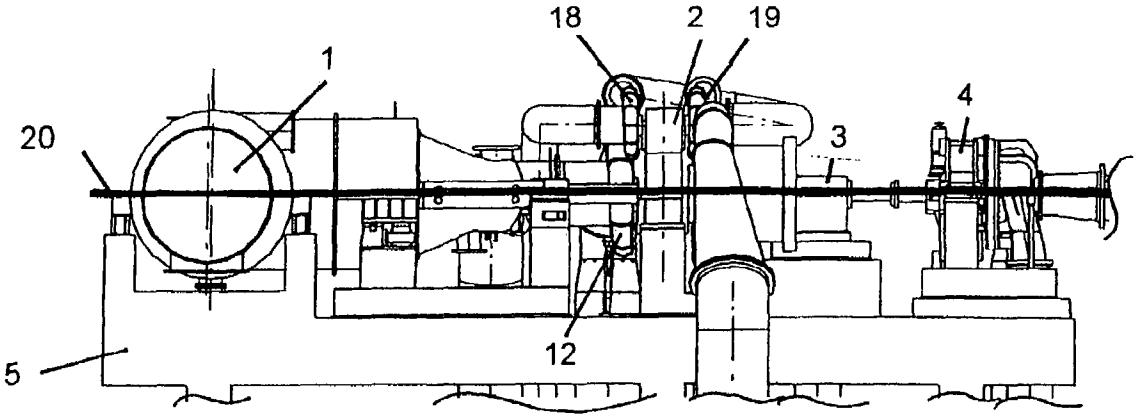
FIG. 1 is a lateral view of a line of machines.
Figure 2:
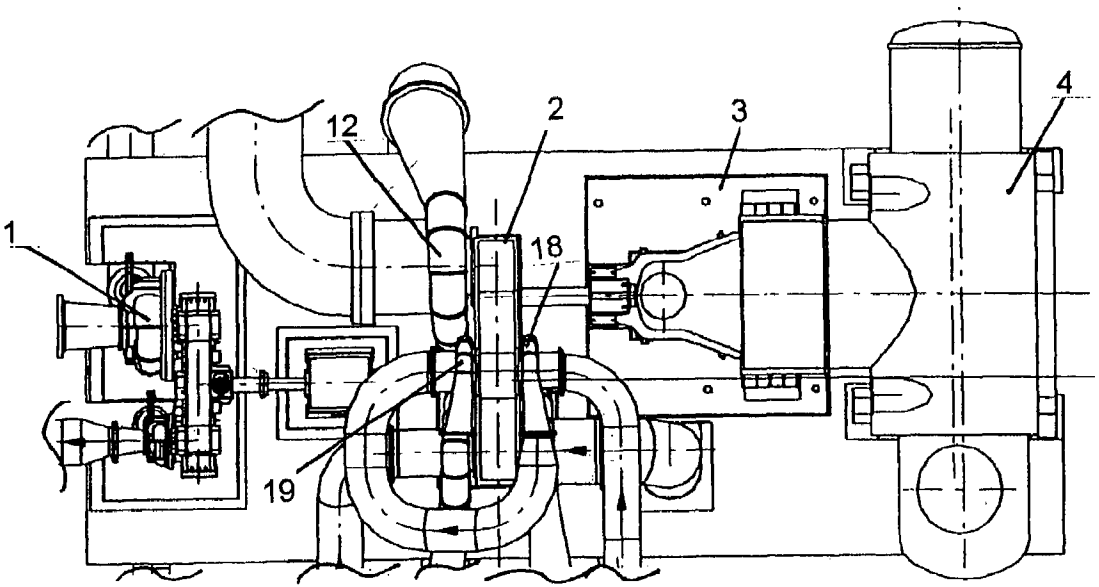
FIG. 2 is a top view of the line of machines of FIG. 1.

Referring to the drawings in particular, the line of machines shown in FIG. 1 is part of a chemical plant for the treatment and the further processing of gases. Such a line of machines comprises a drive unit 1 and a geared compressor 2. Depending on the type of the chemical plant, the line of machines may comprise a motor/generator 3 and an expander 4 as well. The individual units are coupled to one another and are mounted on a base frame, the machine bed 5, which rests on a concrete or steel foundation. A plurality of coolers, a condenser and additional apparatuses needed for the operation of the plant are located under the machine bed 5.

The drive unit 1 is preferably embodied as a steam turbine, whose driven shaft is connected to the driving shaft 6 of the following geared compressor 2. The geared compressor 2 is a multistage turbocompressor with integrated gear and is used for compressing a gas.

Figure 3:
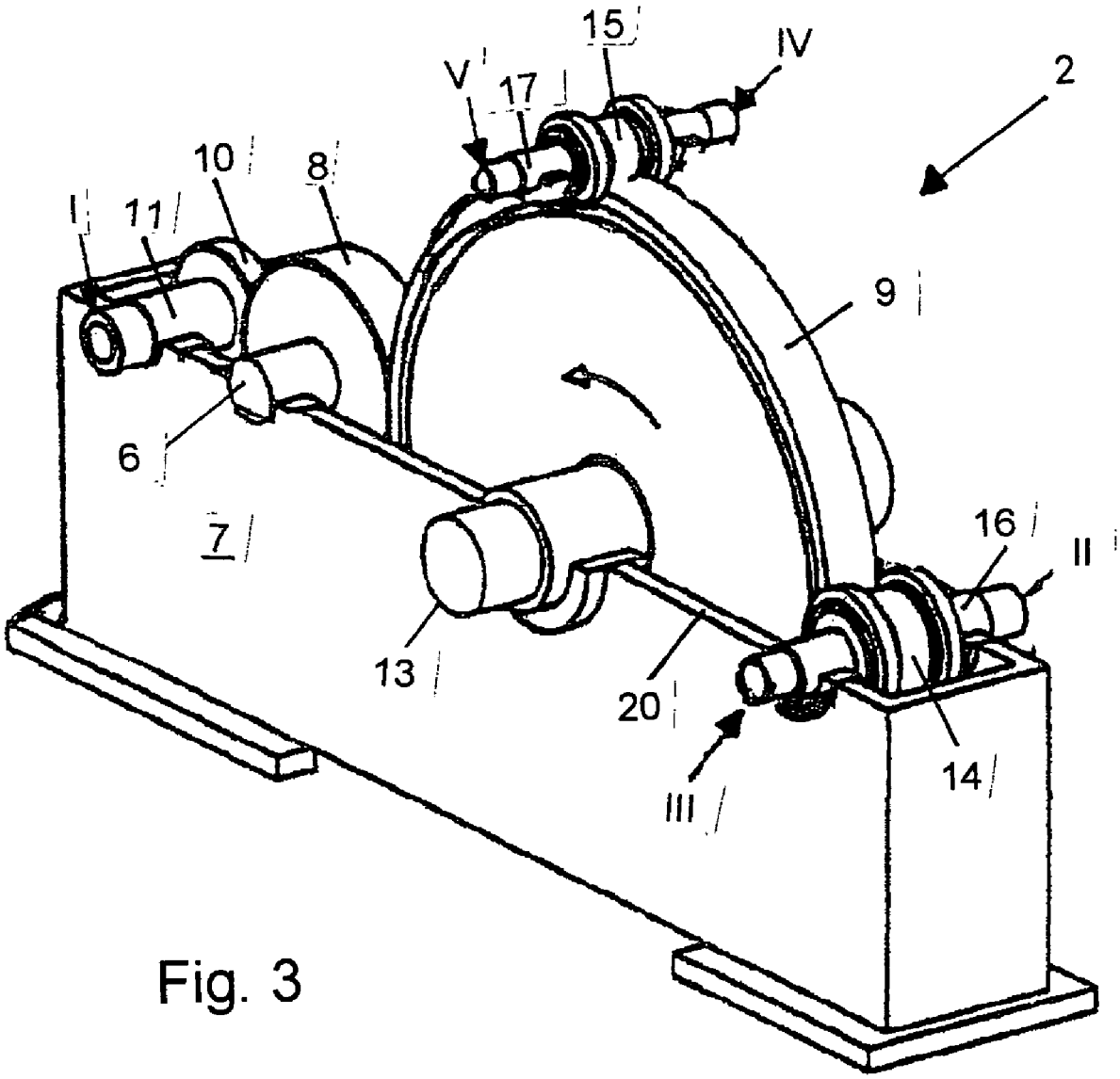
FIG. 3 is a perspective view of the gear of a geared turbocompressor inserted into the line of machines according to FIG. 1.

The geared compressor 2 according to FIG. 3 comprises a housing 7, in which a driving pinion 8, a greater wheel 9 and additional pinions 10, 14, 15 are arranged. The driving pinion 8 is fastened to the driving shaft 6, which is mounted in the housing 7 of the geared compressor 2. On one side, the driving pinion 8 meshes with a first pinion 10, which is fastened, in a manner adapted to rotate in unison, to a first pinion shaft 11. On its one end, the first pinion shaft 11 has a bladed wheel, which rotates in the spiral housing 12 of a compressor, which represents the first compressor stage I of the multistage geared compressor 2.

On the side facing away from the first pinion 10, the driving pinion 8 meshes with the greater wheel 9, which is fastened, in a manner adapted to rotate in unison, to a shaft 13 mounted in the housing 7. The power of the drive unit 1 fed via the driving pinion 8 is simultaneously released to the greater wheel 9 and the first pinion 10 belonging to the first compressor stage I.

The greater wheel 9 meshes with a second pinion 14 and a third pinion 15, which are fastened, in a manner adapted to rotate in unison, to a second and third pinion shaft 16, 17, respectively, mounted in the housing 7. At its ends, the second pinion shaft 16 has the bladed wheels of a second and third compressor stage II, III. At its ends, the third pinion shaft 17 has the bladed wheels of a fourth and fifth compressor stage IV, V with the spiral housings 18, 19. All compressor stages are mounted in an overhung manner on the corresponding pinion shafts.

The driving shaft 6, first pinion shaft 11, second pinion shaft 16 and shaft 13 of the greater wheel 9 lie in the same horizontal plane 20. The third pinion shaft 17 lies above this plane 20. In the view of FIG. 3, in relation to the greater wheel 9, the driving pinion 8 is in the 9 o'clock position, the second pinion 14 is in the 3 o'clock position and the third pinion 15 is in the 12 o'clock position. In relation to the driving pinion 8, the first pinion 10 is in the 9 o'clock position and the greater wheel 9 is in the 3 o'clock position.

The core pieces of the line of machines are the geared compressor 2 and the steam turbine as the drive unit 1. The motor/generator 3 and the expander 4 are components, which can also be omitted together or alone depending on the type of the chemical process. If a motor/generator 3 is installed, then it is connected either directly or via a gear to the shaft 13 of the greater wheel 9.

The line of machines can be started with the steam turbine as the drive unit 1, if steam is available. The motor (motor/generator 3 connected as a motor) then takes over the drive of the line of machines from the synchronous speed of the motor. The expander 4 releases power only if the chemical process has been started, and the exhaust gas or exhaust steam from the process drives the expander 4. The expander 4 may also be operated with air, which the geared compressor 2 has compressed, so that some of the energy can be recovered.

The line of machines may also be started with the motor (motor/generator 3 connected as a motor). If steam is only generated once after the start as a result of the ongoing chemical process, then the steam turbine, as the drive unit 1, then further drives the line of machines.

If the expander 4 is absent, and if only one generator (motor/generator 3 connected as a generator) is installed, the steam turbine, as the drive unit 1, releases so much power that the geared compressor 2 can be operated and the additional power can be fed as electric energy from the generator 3 into the power supply.

While a specific embodiment of the invention has been shown and described in detail to illustrate the application of the principles of the invention, it will be understood that the invention may be embodied otherwise without departing from such principles.

What is claimed is:

1. A multistage turbo compressor comprising:

a geared compressor with an integrated gear and a housing, said housing having a side surface and an upper surface perpendicular to said side surface, said upper surface defining a horizontal plane, said horizontal plane being perpendicular to said side surface, said integrated gear including:

a central greater wheel;

a plurality of pinions meshing with said greater wheel, said plurality of pinions including a first compressor stage pinion and a driving pinion;

a plurality of pinion shafts including a first compressor stage pinion shaft and a driving shaft pinion, wherein said first compressor stage pinion is mounted in a manner adapted to rotate in unison with said first compressor stage pinion shaft;

a plurality of bladed wheels respectively of one of a plurality of compressor stages, each of said compressor stages being mounted on an end of a respective one of said pinion shafts, said greater wheel meshing with said driving pinion, said driving pinion being mounted on said driving shaft in a manner adapted to rotate in unison therewith, an axis of said driving pinion and an axis of said greater wheel being arranged in said horizontal plane, said driving pinion meshing with said driving pinion of a first compressor stage; and a drive unit connected to said driving shaft, said drive unit being arranged with said geared compressor in a line of machines with an axis of said drive unit and said axis of said central greater wheel of said geared compressor arranged in said horizontal plane.

2. A turbocompressor in accordance with claim 1, wherein said plurality of pinions meshing with said central greater wheel are arranged in said horizontal plane running through the axis of the greater wheel and above said plane.

3. A turbocompressor in accordance with claim 1, wherein said drive unit comprises a steam turbine.

4. A turbocompressor in accordance with claim 3, further comprising:

a motor/generator; and an expander, wherein said geared compressor is arranged in said line of machines between said steam turbine on one side and said motor/generator connected to said expander on the other side, and an axis of said drive unit, of said greater wheel of said geared compressor, of said motor/generator and of said expander are arranged in said horizontal plane.

5. A multistage turbocompressor comprising:

a geared compressor with an integrated gear including:

a first gear shaft;

a first gear having a defined first gear axis, said first gear shaft being connected to said first gear;

a driving shaft;

a driving pinion having a defined driving pinion axis, said driving pinion being located opposite said first gear, said driving shaft being connected to said driving pinion, said driving pinion engaging said first gear;

a first compressor stage shaft having a first bladed wheel;

a second compressor stage shaft having a second bladed wheel;

a third compressor stage shaft having a third bladed wheel;

a first compressor stage pinion having a defined first compressor stage pinion axis, said first compressor stage pinion being located opposite said driving pinion, said first compressor stage pinion engaging said driving pinion, said first compressor stage shaft with said first bladed wheel being connected to said first compressor stage pinion;

a second pinion having a defined second pinion axis, said second pinion being located adjacent said first gear, said second pinion engaging said first gear, said second compressor stage shaft with said second bladed wheel being connected to said second pinion, said third compressor stage shaft with said third bladed wheel being connected to said second pinion, said first gear having a size greater than size of said driving pinion, said first compressor stage pinion and said second pinion, said first gear, said first compressor stage pinion, said driving pinion and said second pinion being positioned such that said first gear axis is horizontally aligned with said first compressor stage pinion axis, said driving pinion axis and said second pinion axis, whereby said first gear axis, said first compressor stage pinion axis, said driving pinion axis and said second pinion axis are located on a same horizontal plane;

a drive unit arranged with said geared compressor in a line of machines, said drive being connected to said driving shaft, said drive unit having a drive unit axis, said drive unit being arranged such that said drive unit axis is horizontally aligned with said first gear axis.

6. A turbocompressor in accordance with claim 5, wherein said drive unit comprises a steam turbine.

7. A turbocompressor in accordance with claim 6, further comprising:

a motor/generator; and an expander, wherein said geared compressor is arranged in said line of machines between said steam turbine on one side and said motor/generator connected to said expander on the other side, and an axis of said drive unit, said first gear axis, an axis of said motor/generator and an axis of said expander are arranged in said horizontal plane.

8. A multistage turbocompressor comprising:

a geared compressor including a housing and an integrated gear, said housing having a side surface and an upper surface, said upper surface defining a horizontal plane, said horizontal plane being substantially perpendicular to said side surface, said integrated gear including:

a first gear shaft;

a first gear having a defined first gear axis, said first gear shaft being connected to said first gear;

a driving shaft;

a driving pinion having a defined driving pinion axis, said driving pinion being located opposite said first gear, said driving shaft being connected to said driving pinion, said driving pinion engaging said first gear;

a first compressor stage shaft having a first bladed wheel;

a second compressor stage shaft having a second bladed wheel;

a third compressor stage shaft having a third bladed wheel;

a first compressor stage pinion having a defined first compressor stage pinion axis, said first compressor stage pinion being located opposite said driving pinion, said first compressor stage pinion engaging said driving pinion, said first compressor stage shaft with said first bladed wheel being connected to said first compressor stage pinion, said first compressor stage pinion and said driving pinion being located on one side of said first gear;

a second pinion having a defined second pinion axis, said second pinion being located adjacent to said first gear, said second pinion being located on another side of said first gear, said second pinion engaging said first gear, said second compressor stage shaft with said second bladed wheel being connected to said second pinion, said third compressor stage shaft with said third bladed wheel being connected to said second pinion, said first gear having a size greater than size of said driving pinion, said first compressor stage pinion and said second pinion, said first gear, said first compressor stage pinion, said driving pinion and said second pinion being mounted to said housing such that said first gear axis, said first compressor stage pinion axis, said driving pinion axis and said second pinion axis is horizontally aligned with said horizontal plane defined by said housing, said first compressor stage pinion, said driving pinion, said first gear and said second pinion being substantially perpendicular to said horizontal plane;

a drive unit arranged with said geared compressor in a line of machines, said drive unit being connected to said driving shaft, said drive unit having a drive unit axis, said drive unit axis being horizontally aligned with said horizontal plane defined by said housing.

9. A turbocompressor in accordance with claim 8, wherein said drive unit comprises a steam turbine.

10. A turbocompressor in accordance with claim 8, further comprising:

a motor/generator having a motor/generator axis; and an expander having an expander axis, wherein said geared compressor is arranged in said row of machines between said steam turbine on one side and said motor/generator connected to said expander on the other side, and said drive unit axis of said drive unit, said first gear axis, said motor/generator axis of said motor/generator and said expander axis of said expander are arranged in said horizontal plane.

11. A turbocompressor in accordance with claim 1, wherein said drive unit, said greater wheel and said plurality of pinions are substantially perpendicular to said horizontal plane.

12. A turbocompressor in accordance with claim 11, wherein said first compressor stage pinion and said driving pinion are located on one side of said greater wheel.

13. A turbocompressor in accordance with claim 12, wherein said axis of said driving pinion and said axis of said greater wheel being substantially perpendicular to said horizontal plane.

14. A turbocompressor in accordance with claim 5, wherein said geared compressor includes a housing having a side surface and an upper surface, said upper surface defining said horizontal plane such that said horizontal plane is substantially perpendicular to said side surface, said drive unit, said first gear, said first compressor stage pinion, said second pinion and said driving pinion being substantially perpendicular to said horizontal plane.

15. A turbocompressor in accordance with claim 14, wherein said first compressor stage pinion and said driving pinion are located on one side of said first gear, said second pinion being located on another side of said first gear.

16. A turbocompressor in accordance with claim 8, wherein said integrated gear includes a third pinion, said third pinion engaging said first gear, said third pinion being located at a position above said first compressor stage pinion, said driving pinion and said second pinion.

17. A turbocompressor in accordance with claim 16, wherein said driving pinion axis is parallel to said first compressor stage pinion axis, said first gear axis and said second pinion axis.

18. A turbocompressor in accordance with claim 16, wherein said driving pinion axis, said first compressor stage pinion axis, said first gear axis and said second pinion axis traverses said horizontal plane in a direction substantially perpendicular to said horizontal plane.

19. A turbocompressor in accordance with claim 15, wherein said driving pinion axis, said first compressor stage pinion axis, said first gear axis and said second pinion axis traverses said horizontal plane in a direction substantially perpendicular to said horizontal plane.

20. A turbocompressor in accordance with claim 13, wherein said axis of said driving pinion axis and said axis of said greater wheel traverse said horizontal plane in a direction substantially perpendicular to said horizontal plane.

* * * * *